US010559443B2

(12) United States Patent
Zidan et al.

(10) Patent No.: US 10,559,443 B2
(45) Date of Patent: Feb. 11, 2020

(54) LIQUID DIELECTRIC ELECTROSTATIC MEMS SWITCH AND METHOD OF FABRICATION THEREOF

(71) Applicant: King Abdullah University of Science and Technology, Thuwal (SA)

(72) Inventors: Mohammed Affan Zidan, Thuwal (SA); Jurgen Kosel, Thuwal (SA); Khaled Nabil Salama, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 122 days.

(21) Appl. No.: 15/735,213

(22) PCT Filed: Jun. 14, 2016

(86) PCT No.: PCT/IB2016/053504
§ 371 (c)(1),
(2) Date: Dec. 11, 2017

(87) PCT Pub. No.: WO2016/203369
PCT Pub. Date: Dec. 22, 2016

(65) Prior Publication Data

US 2018/0174788 A1 Jun. 21, 2018

Related U.S. Application Data

(60) Provisional application No. 62/175,396, filed on Jun. 14, 2015.

(51) Int. Cl.
*H01H 59/00* (2006.01)
*H01H 49/00* (2006.01)

(52) U.S. Cl.
CPC ..... *H01H 59/0009* (2013.01); *H01H 49/00* (2013.01); *H01H 59/00* (2013.01);
(Continued)

(58) Field of Classification Search
CPC .... H01H 59/0009; H01H 49/00; H01H 59/00; H01H 2059/0018; H01H 2059/0072; H01H 2201/038
(Continued)

(56) References Cited

U.S. PATENT DOCUMENTS 5,367,429 A * 11/1994 Tsuchitani ..... B81B 3/0008 361/280
5,452,878 A 9/1995 Gravesen et al.
(Continued)

FOREIGN PATENT DOCUMENTS

DE 4119955 A1 12/1992
DE 4234969 A1 4/1993
(Continued)

OTHER PUBLICATIONS

Chen, C. H., et al. "Liquid RF MEMS wideband reflective and absorptive switches," IEEE Transactions on Microwave Theory and Techniques, vol. 55, Issue 12, Dec. 10, 2007, pp. 2919-2929. I.
(Continued)

*Primary Examiner* — Didarul A Mazumder
(74) *Attorney, Agent, or Firm* — Patent Portfolio Builders PLLC

(57) ABSTRACT

A microelectromechanical system (MEMS) switch with liquid dielectric and a method of fabrication thereof are provided. In the context of the MEMS switch, a MEMS switch is provided including a cantilevered source switch, a first actuation gate disposed parallel to the cantilevered source switch, a first drain disposed parallel to a movable end of the cantilevered source switch, and a liquid dielectric disposed within a housing of the microelectromechanical system switch.

20 Claims, 9 Drawing Sheets

(52) U.S. Cl.
CPC ..... *H01H 2059/0018* (2013.01); *H01H 2059/0072* (2013.01); *H01H 2201/038* (2013.01)

(58) Field of Classification Search
USPC ..... 438/52
See application file for complete search history.

(56) References Cited

U.S. PATENT DOCUMENTS

| | | | | |
|---|---|---|---|---|
| 2003/0059973 | A1* | 3/2003 | Trainor | H01H 59/0009 438/52 |
| 2010/0140066 | A1* | 6/2010 | Feng | H01H 1/0094 200/181 |
| 2011/0073788 | A1* | 3/2011 | Marcus | F16K 99/0001 251/30.01 |
| 2012/0138437 | A1* | 6/2012 | Ng | H01H 1/0094 200/181 |
| 2012/0268985 | A1* | 10/2012 | Chang | H03H 9/2457 365/164 |
| 2015/0130509 | A1* | 5/2015 | He | G11C 17/16 326/41 |
| 2016/0293371 | A1* | 10/2016 | Liu | H01H 59/0009 |

FOREIGN PATENT DOCUMENTS

| | | | |
|---|---|---|---|
| EP | 2706545 | A2 | 3/2014 |
| WO | 03036669 | A1 | 5/2003 |

OTHER PUBLICATIONS

Endress+Hauser. "Relative dielectric constant εr(dk value) of liquids and solid materials." [retrieved on Jul. 18, 2016], retrieved from the internet: <URL: http://www.forberg.com/pdf/techSup/EH_Dk_list_(2).pdf>, (dated May 13, 2000), 74 pages.

International Search Report and Written Opinion of the International Searching Authority for International Patent Application No. PCT/IB2016/053504 dated Jul. 27, 2016.

Zidan, M.A., et al.; "Low Pull-In Voltage Electrostatic MEMS Switch Using Liquid Dielectric," IEEE International Midwest Symposium on Circuits and Systems (MWSCAS), Texas, USA, Aug. 2014, 4 pages.

McLanahan, A., et al. "A dielectric liquid contact thermal switch with electrowetting actuation"; Journal of Micromechanics and Microengineering, vol. 21, No. 10, Sep. 29, 2011, p. 104009.

* cited by examiner

LIQUID DIELECTRIC ELECTROSTATIC MEMS SWITCH AND METHOD OF FABRICATION THEREOF

CROSS-REFERENCE TO RELATED APPLICATIONS

The present application is a national phase entry of International Application No. PCT/IB2016/053504, filed Jun. 14, 2016, which claims priority to U.S. Provisional Patent Application No. 62/175,396, filed Jun. 14, 2015. Both of these applications are incorporated herein by reference in their entireties.

TECHNOLOGICAL FIELD

An example embodiment of the present invention relates to microelectromechanical system (MEMS) switches and, more particularly, to a MEMS switch with a liquid dielectric.

BACKGROUND

Typical transistors, such as complementary metal-oxide-semiconductor (CMOS) switches, have advantages such as small size and speed. However, the smaller and faster the switch, the more the transistor may suffer leakage. Transistors also are unreliable in extreme temperature or pressure conditions, such as space and mining applications. Further, transistors cannot handle high voltage without suffering transistor shoot-through.

Typical MEMS switches have many advantages compared to solid state CMOS switches, including very high ON/OFF ratios, very low power consumption, and excellent input/output isolation. These advantages allow MEMS switches to be used in many applications, including reconfigurable antennas and circuits, which in turn are used in radar, communication, and instrumentation systems. However, mechanical switches traditionally suffer from high pull-in voltages and slow response. These limitations have prevented the use of MEMS switches in a wide range of applications. MEMS switches utilizing low voltage also suffer from significant leakage.

Many efforts have been made to improve the MEMS switch response by applying new structures and materials. In general, the concept behind electrostatic MEMS switches is to engineer a parallel plate capacitor to create an actuation force, hence switching ON or OFF. The net force applied to the parallel plate is the difference between the electrostatic force and the structural damping force, which is defined as $$F = \frac{C_p}{2d} V_d^2 - k \cdot |d - d_0|, \tag{1}$$

where $$C_p = \frac{\varepsilon_o \varepsilon_r A}{d}. \tag{2}$$

$C_p$ represents the parallel plate capacitance, d represents the gap separation between the parallel plates, $d_0$ represents the gap at rest, $\varepsilon_0$ represents the permittivity of air, $\varepsilon_r$ represents the permittivity of the gap filling material, $V_d$ represents the applied voltage, and k represents the spring constant of the switch moving part. Based on equation (1), the actuation force at a given applied voltage can be enhanced either by reducing the spring constant of the switch or by increasing its parallel plate capacitance. The first approach can be achieved using techniques, such as by engineering new structures with lower spring constant or by using more flexible materials to fabricate the switch-moving parts.

The second strategy to decrease the actuation voltage is by increasing $C_p$ to enhance the electrostatic force. According to equation (1), this can be achieved by increasing the area, reducing or reshaping the air gap, or using a high $\varepsilon_r$ filling material. The gap thickens as a technology dependent parameter. Increasing the area will reduce the density and yield of the fabricated device. Moreover, $\varepsilon_r$ cannot be increased by using a common rigid dielectric, because doing so would prevent actuation of the switch by blocking its moving part.

BRIEF SUMMARY

A MEMS switch and method of fabrication thereof are provided in accordance with example embodiments described herein. In a first set of example embodiments, a microelectromechanical system switch is provided that includes a cantilevered source switch, a first actuation gate disposed parallel to the cantilevered source switch, a first drain disposed parallel to a movable end of the cantilevered source switch, and a liquid dielectric disposed within a housing of the microelectromechanical system switch.

In some embodiments, the liquid dielectric fills at least a portion of a volume between the cantilevered source and the first actuation gate. In some embodiments, the first drain is disposed outside the liquid dielectric. In some embodiments, the microelectromechanical system switch also includes a second actuation gate, wherein the first and second accusation gates are disposed on opposite sides of and parallel to the cantilevered source switch. In some embodiments, the microelectromechanical system switch also includes a second drain, wherein the first and second drains are disposed on opposite sides of and parallel to the movable end of the cantilevered source switch.

In some embodiments, simultaneous activation of the first and second actuation gates causes the cantilevered source switch to maintain an unactuated position. In some embodiments, the first drain and second drain are electrically shorted. In some embodiments, the liquid dielectric is water. In some embodiments, the liquid dielectric is one of water, gasoline, hydrazine, ethanol, olive oil, or acetic acid. In some embodiments, the microelectromechanical system switch satisfies an XOR logic, in an instance in which the first and second actuation gates are electrically connected to first and second input logic gate.

In another set of example embodiments, a method of fabricating a microelectromechanical system switch is provided. In such embodiments, the method includes providing a cantilevered source switch, providing a first actuation gate disposed parallel to the cantilevered source switch, providing a first drain parallel to a movable end of the cantilevered source switch, and providing a liquid dielectric disposed within a housing of the microelectromechanical system switch.

In some embodiments of the method, the liquid dielectric fills at least a portion of a volume between the cantilevered source and the first actuation gate. In some embodiments of the method, the first drain is disposed outside the liquid dielectric. In some embodiments, the method also includes providing a second actuation gate, wherein the first and second accusation gates are disposed on opposite sides of and parallel to the cantilevered source switch.

In some embodiments, the method also includes providing a second drain, wherein the first and second drains are disposed on opposite sides of and parallel to the movable end of the cantilevered source switch. In some embodiments of the method, activation of the first and second actuation gates causes the cantilevered source switch to maintain an unactuated position. In some embodiments of the method, the first drain and second drain are electrically shorted. In some embodiments of the method, the liquid dielectric is water. In some embodiments of the method, the liquid dielectric is one of water, gasoline, hydrazine, ethanol, olive oil, or acetic acid. In some embodiments of the method, the microelectromechanical system switch satisfies an XOR logic, in an instance in which the first and second actuation gates are electrically connected to first and second input logic gates.

BRIEF DESCRIPTION OF THE DRAWINGS

Figure 1A:
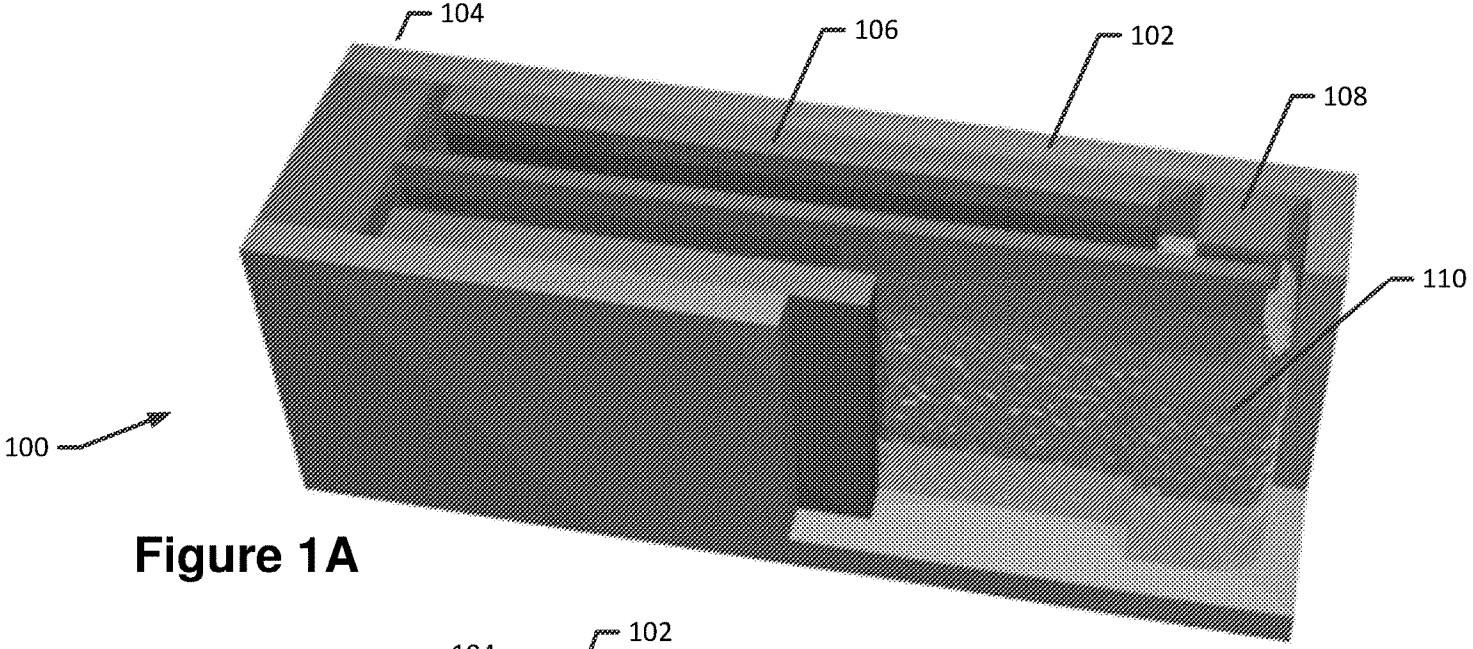
Figure 1B:
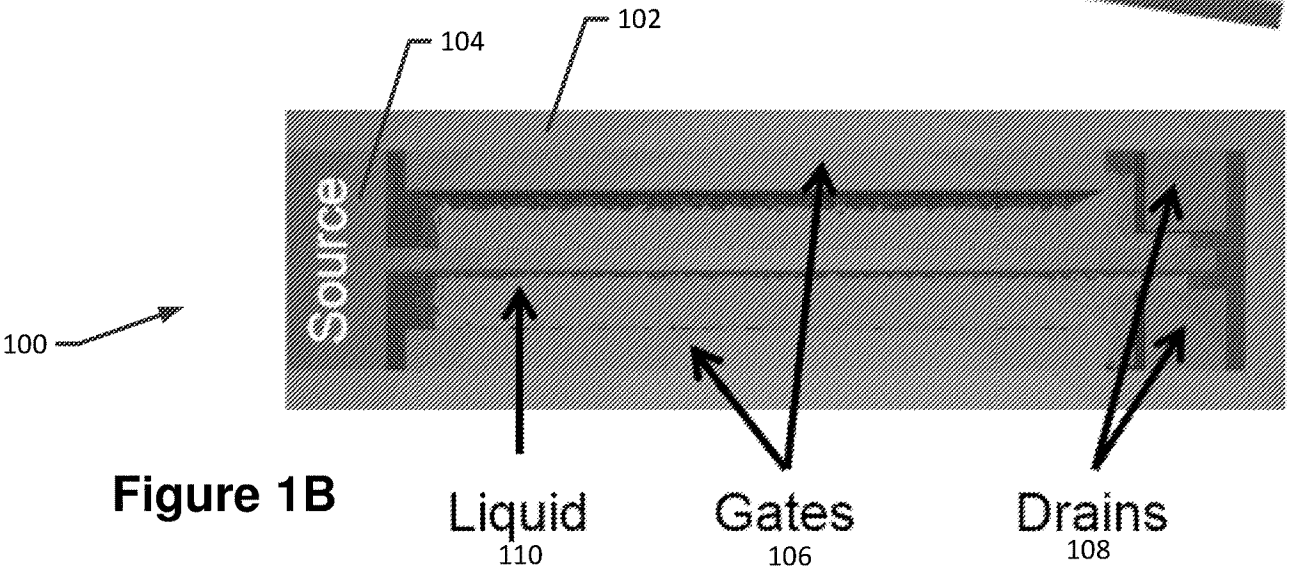
Figure 2:
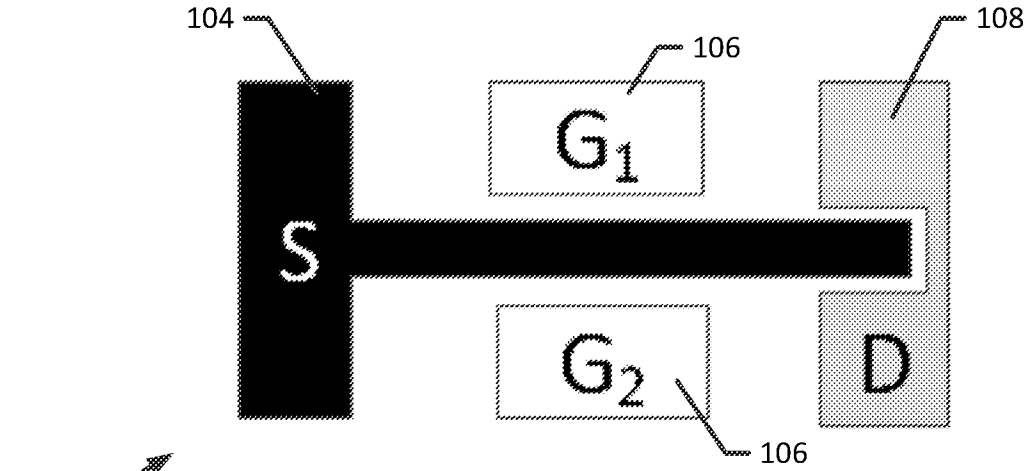
Figure 3:
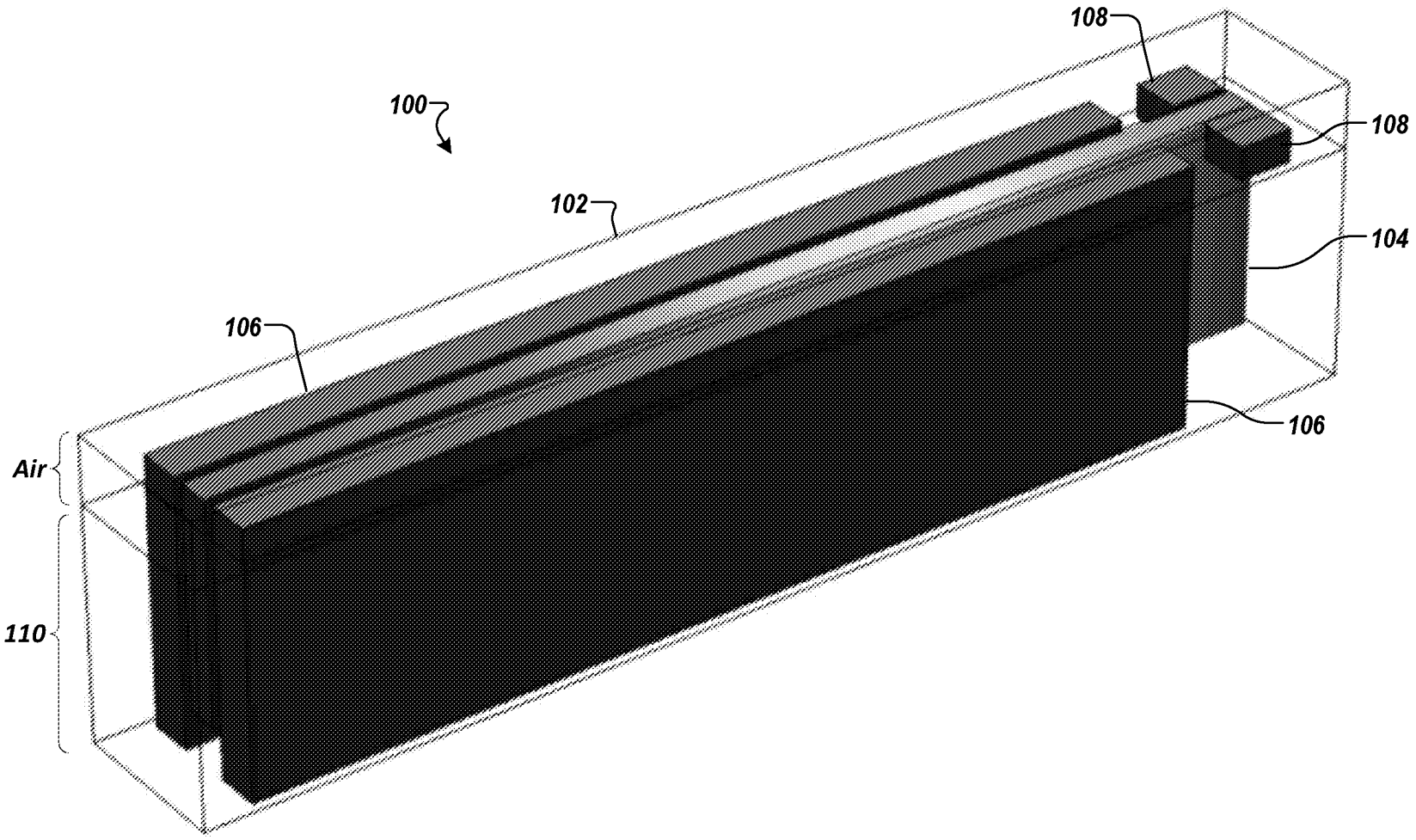
Figure 4:
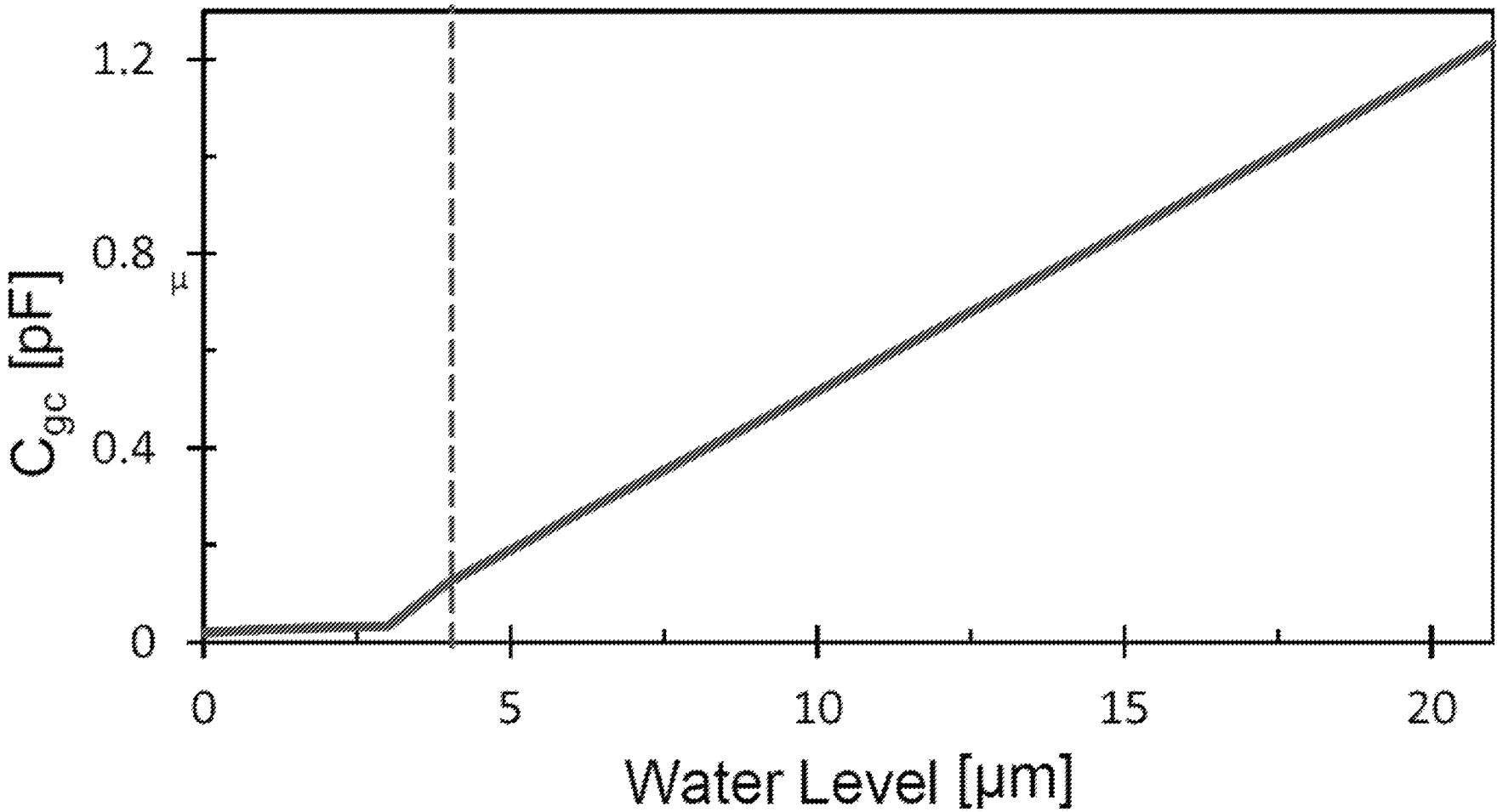
Figure 5:
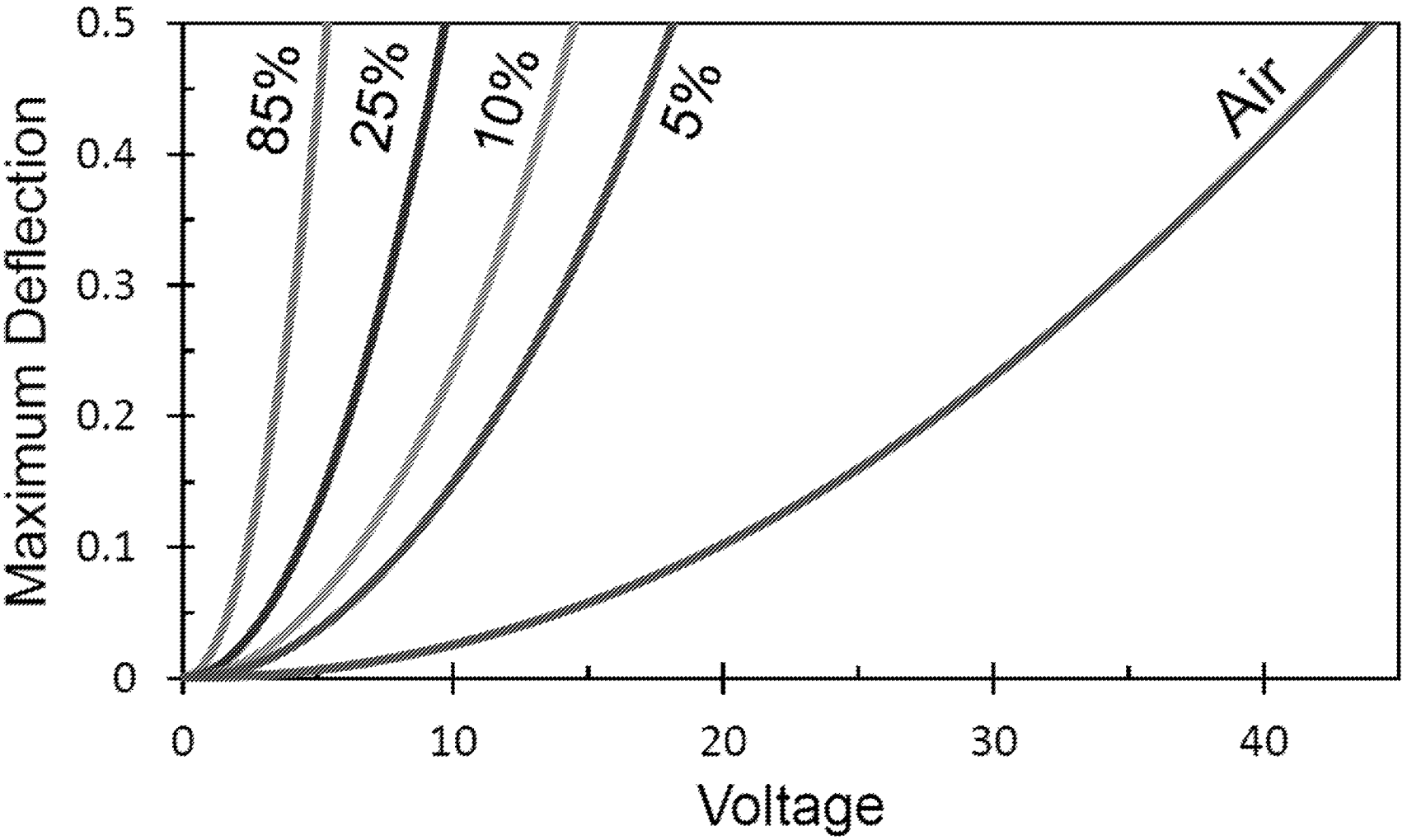
Figure 6:
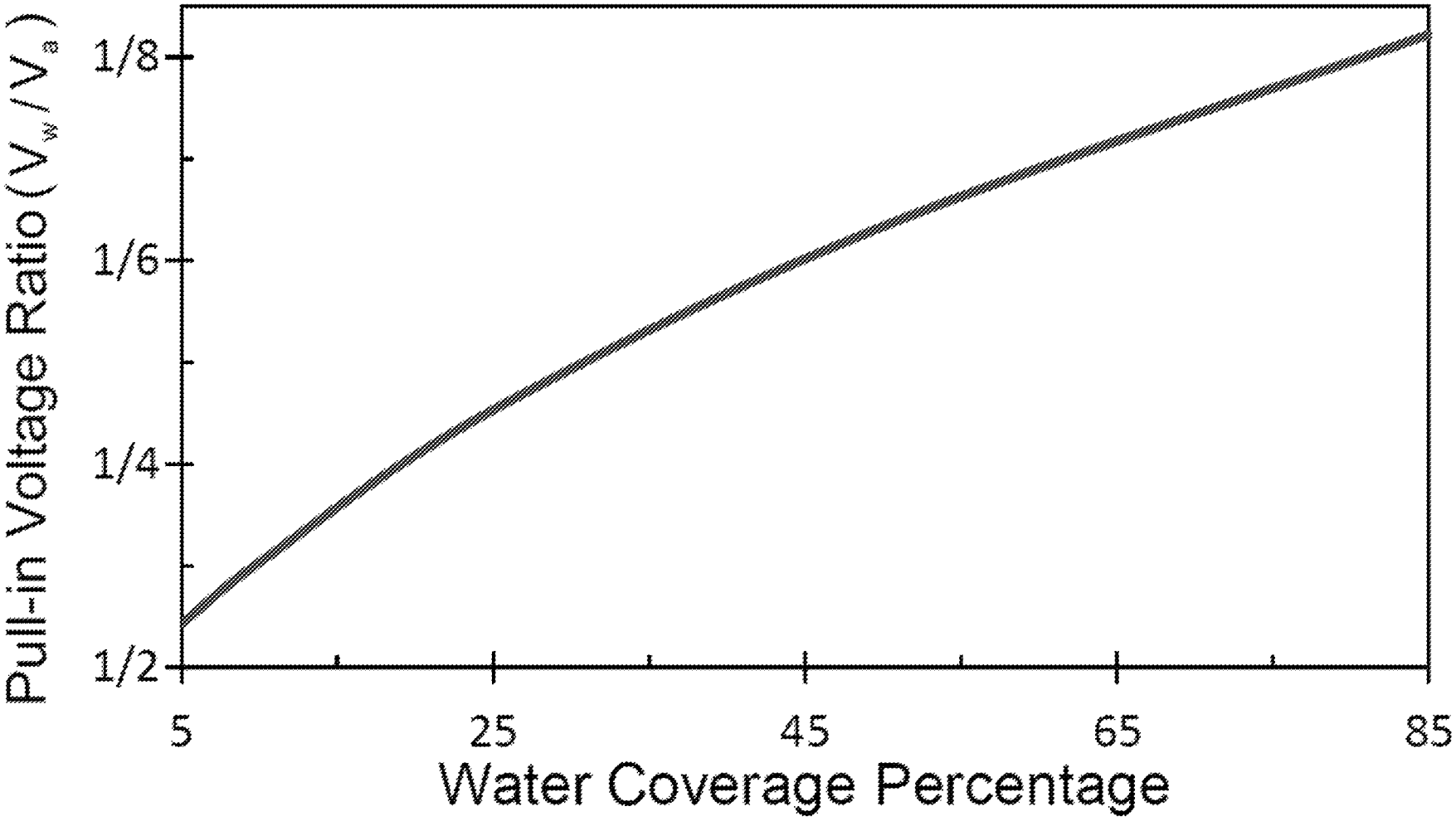
Figure 7A:
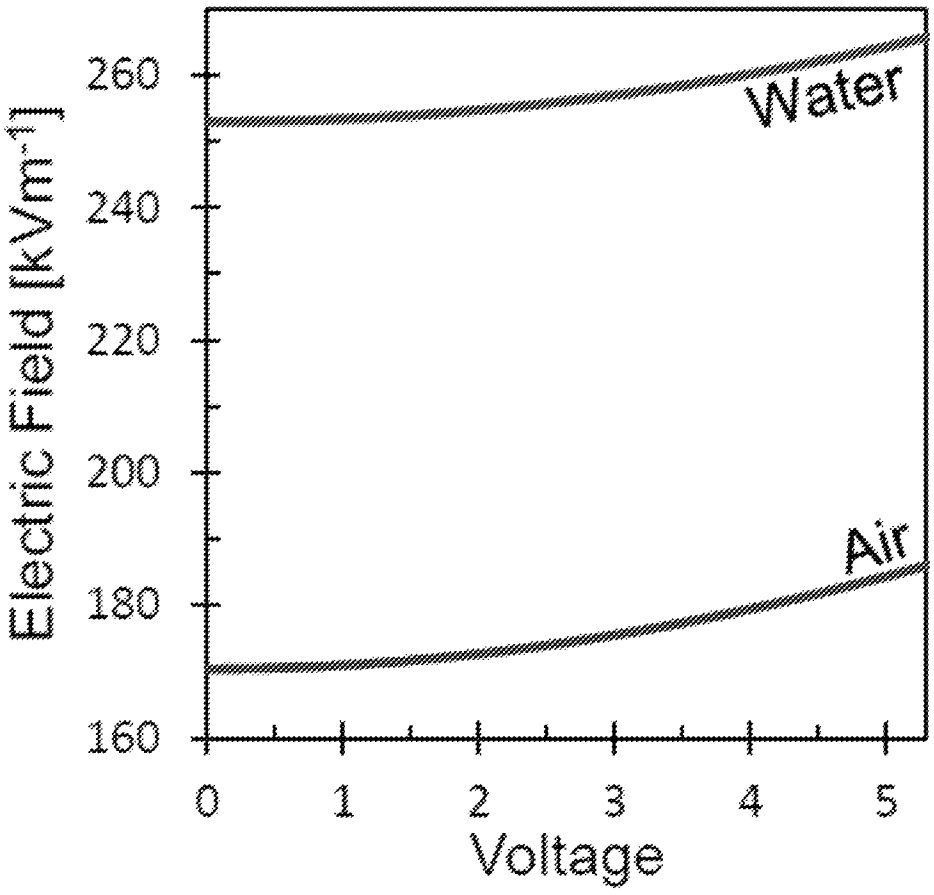
Figure 7B:
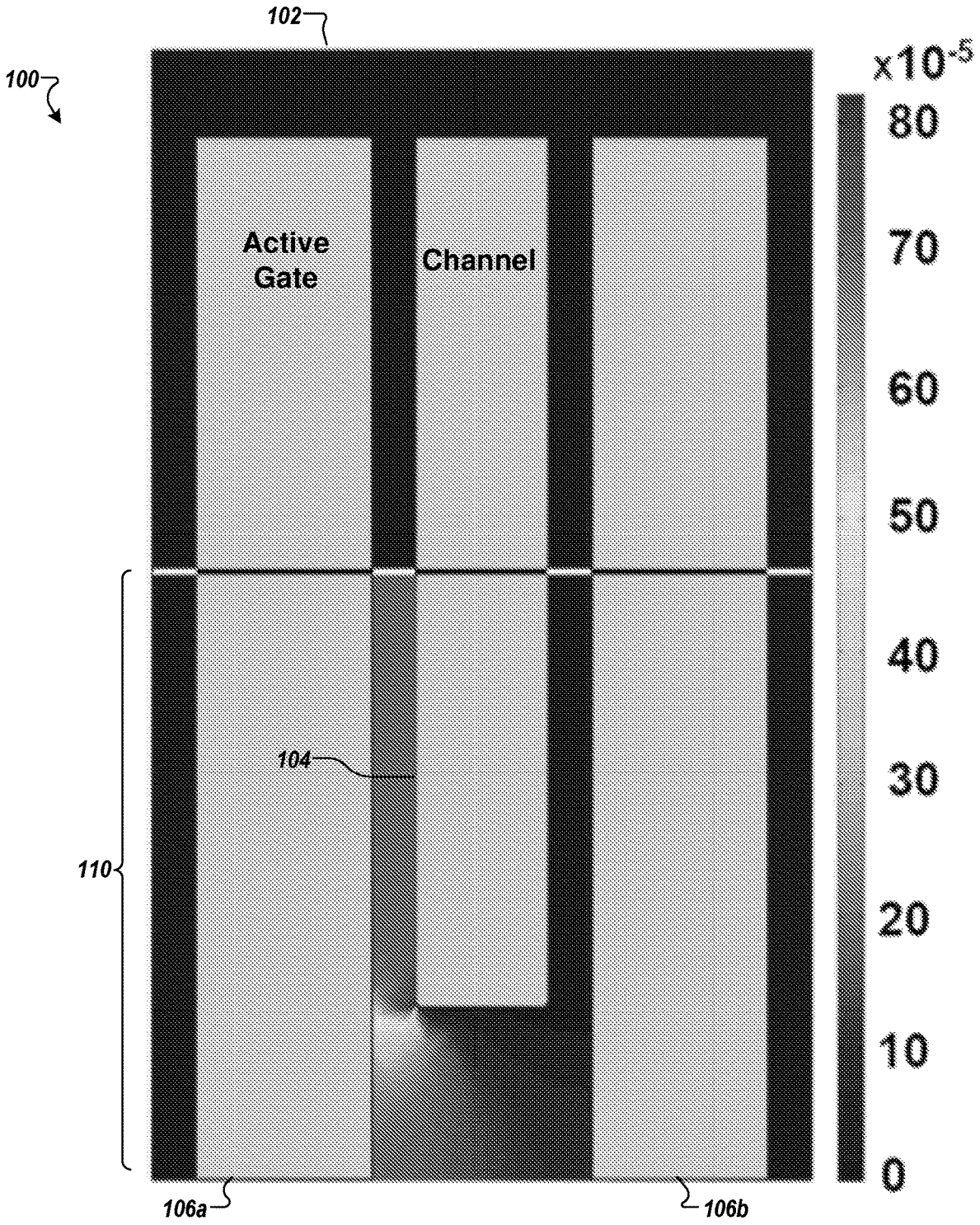
Figure 8:
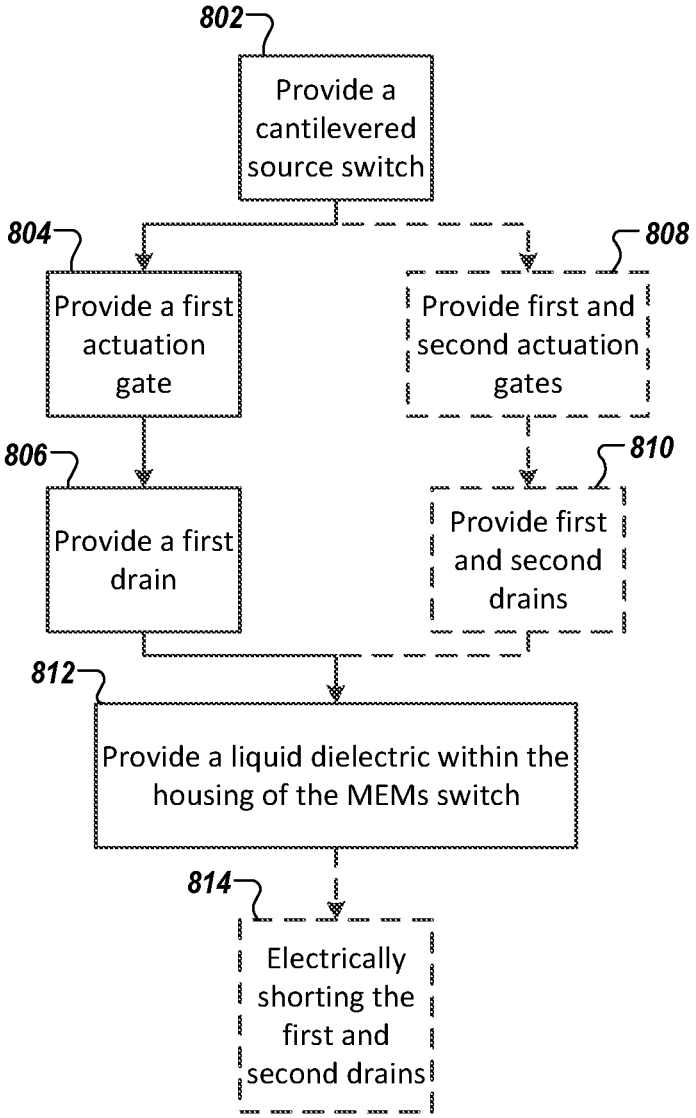

Having thus described example embodiments of the invention in general terms, reference will now be made to the accompanying drawings, which are not necessarily drawn to scale, and wherein:

FIG. 1A illustrates an oblique cross sectional view of an example liquid dielectric MEMS switch in accordance with an example embodiment of the present invention;

FIG. 1B illustrates a cross sectional view of an example liquid dielectric MEMS switch in accordance with an example embodiment of the present invention;

FIG. 2 illustrates a cross sectional view of an example liquid dielectric MEMS switch with shorted drains in accordance with an example embodiment of the present invention;

FIG. 3 illustrates an oblique view of an example liquid dielectric MEMS switch in an example embodiment of the present invention;

FIG. 4 illustrates gate-source capacitance versus liquid dielectric level in the switch gaps in accordance with an embodiment of the present invention;

FIG. 5 illustrates a source deflection versus an applied voltage for various liquid dielectric levels in accordance with an embodiment of the present invention;

FIG. 6 illustrates an example reduction in pull-in voltage required for full actuation versus liquid dielectric level in accordance with an embodiment of the present invention;

FIG. 7A illustrates the maximum electric field versus the applied voltage on the gate and source in both air and liquid dielectric at a specified level in accordance with an embodiment of the present invention;

FIG. 7B illustrates a vertical cross section of a liquid dielectric MEMS switch with an electric field displacement in accordance with an embodiment of the present invention; and FIG. 8 illustrates a process for fabricating a liquid dielectric MEMS switch in accordance with an embodiment of the present invention.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout.

Overview

In an example embodiment, a new MEMS switch and a method of fabricating the new MEMS switch are provided. The MEMS switch may utilize a liquid dielectric which may increase the capacitance of the switch rather than using the liquid as a conducting medium. Further, the dielectric may reduce the pull-in voltage of the liquid dielectric MEMS switch. In an example embodiment, a lateral dual-gate MEMS switch with liquid dielectric may reduce pull-in voltage by greater than 8 times to become as low as 5.36V.

In some examples embodiments, the liquid dielectric MEMS switch may be configured as a single switch XOR logic gate, which may significantly reduce its required area.

Liquids have a relativity high permittivity compared to gases and allow mechanical parts to move. These properties enable liquids to be used as flexible dielectrics in the MEMS domain. The usage of a liquid as a flexible dielectric may reduce the actuation voltage of electrostatic MEMS switches. Based on equation (1), the actuation voltage is inversely proportional to the square root of the parallel plate capacitance, as illustrated in equation 3 below.

$$V_d \propto \sqrt{\frac{d}{C_p}} \propto \frac{d}{\sqrt{A\varepsilon_r}} \tag{3}$$

Hence, the actuation voltage is inversely proportional to $\sqrt{\varepsilon_r}$. Table 1 shows the relative permittivity for different liquids and gases. In addition, Table 1 shows the theoretical reduction in the actuation voltage based on equation 3.

TABLE 1

PERMITTIVITY OF DIFFERENT GASES AND LIQUIDS.

| Material | Permittivity | Max. Voltage Reduction |
|---|---|---|
| Vacuum | 1.0 | — |
| Nitrogen | 1.0 | — |
| Arragon | 1.0 | — |
| Mercury | 1.0 | — |
| Fluorine | 2.0 | 1.41 |
| Gasoline | 2.0 | 1.41 |
| Acetic Acid | 6.2 | 2.49 |
| Olive Oil | 3.1 | 1.76 |
| Ethanol | 24.3 | 4.93 |
| Hydrazine | 52 | 7.21 |
| Glycerine | 68 | 8.25 |
| Water | 80.4 | 8.97 |

Liquid dielectric shortfalls, such as stiction, surface tension and damping may be addressed by the design of the liquid dielectric MEMS switch. For example, stiction may be avoided by limiting or preventing contact between solids, e.g. source and drain, in the liquid environment. In some examples, this is achieved by designing the MEMS structure such that all of its contact point areas are outside the liquid volume. Particular structural designs, some of which may have dual gates as described below, may neutralize the surface tension. Finally, damping may be affected by the choice of liquid and the fill level of the dielectric.

Example Liquid Dielectric MEMS Switch

A liquid dielectric MEMS switch and method of manufacture thereof are provided in accordance with an example embodiment. FIGS. 1A and 1B illustrate an oblique and cross sectional view of an example liquid dielectric MEMS switch 100. The liquid dielectric MEMS switch may include a housing 102, a source 104, an actuation gate 106, a drain 108, and a liquid dielectric 110. The source 104, actuation gate 106, drain 108, and liquid dielectric 110 may be at least partially contained within the housing 102.

The depicted example embodiment is directed toward a dual gate liquid dialectic MEMS switch, although other configurations are contemplated as well, such as a single actuation gate liquid dielectric switch.

The source 104 may be a cantilevered source switch that, in some embodiments, may be anchored at one end. An actuation gate 106 may be disposed in parallel with the cantilevered source switch 104. A drain 108 may be disposed in parallel with the cantilevered source switch 104 near the end of the movable portion. The void between the cantilevered source switch 104, actuation gates 106 and drains 108 may create a moving channel. The moving channel may be filled with a liquid dielectric. The liquid dielectric may be gasoline, acetic acid, olive oil, ethanol, hydrazine, glycerin, water, or any other liquid dielectric with suitable permittivity.

In an example embodiment, the liquid dielectric level is filled below the drain contacts as depicted in FIG. 3, which may cause any contact between the cantilevered source switch 104 and the drain 108 to occur outside of the liquid dielectric. The dielectric level below the drain contacts may reduce or eliminate stiction. In an example embodiment, the cantilevered source switch 104 and actuation gates 106 may be disposed vertically. The vertical disposition of the cantilevered source switch 104 and actuation gates 106 may neutralize surface tension of the liquid dielectric 110, which may in turn assist in keeping the liquid dielectric below the drain 108 contacts of the liquid dielectric MEMS switch 100, regardless of orientation. The vertical disposition of the cantilevered source switch 104 is described relative to the drain 108 which is, in this example, positioned at the top of the MEMS switch 100 for illustrative purposes only (the cantilevered source switch may also be disposed in other orientations).

In an example embodiment of the liquid dielectric MEMS switch 100 with dual actuation gates 108, each of the actuation gates may be electrically connected to a different logic input and the drains 108 may be shorted together, as depicted in FIG. 2. The shorted drain 108 and dual actuation gates 106 wired to different logic inputs may cause the liquid dielectric MEMS switch 100 to satisfy an XOR logic or truth table. The cantilevered source switch 104 may be substantially centered when not actuated, and not be in contact with the drain 108. In an instance in which an actuation gate 106 is activated, the cantilevered source switch may deflect from its prior position and make contact with the drain 108. In this regard, in some embodiments, the cantilevered source switch may include holes to reduce the drag caused by the liquid dielectric when the cantilevered source switch moves. In an instance in which both actuation gates 106 are activated simultaneously, however, the cantilevered source switch 104 may still remain in the substantially centered position.

The cantilevered source switch 104, actuation gates 106, and drains 108 may be made from a suitable conductive material, and in this regard may comprise any MEMS-compatible material. In one example embodiment, these elements may be made from any MEMS-compatible material. In one example embodiment, these elements may be made of gold. Similarly, the dimensions of the cantilevered source switch 104 may also vary in accordance with design goals. For instance, in an example embodiment, the cantilevered source switch 104 dimensions may be 100 μm×20 μm×3 μm and a gap of 3 μm is left below the cantilevered source switch to enable its movement and to allow for liquid dielectric 110 filling. In this example embodiment, the actuation gates 106 may each have a 90μ×24 μm surface area and the parallel plate area between each actuation gate and the cantilevered source switch may be 90 μm×20 μm. The gap between each actuation gate and the cantilevered source switch 104 may be 1 μm and is reduced to 0.5 μm between the cantilevered source switch and the drain 108. The drain 108 may act as a mechanical stop, preventing shorting between the cantilevered source switch 104 and the actuation gates 106.

It should be understood that the dimensions of this example embodiment are provided for illustrative purposes and other dimensions may be used in other example embodiments.

Example Gate-Source Capacitance Versus Liquid Dielectric Level

FIG. 4 illustrates a graph of gate-source (e.g., gate-channel) capacitance versus liquid dielectric level in the switch gaps. In the depicted graph, the vertical axis is the gate-source capacitance ($C_{gc}$), measured in pico Farads (pF), and the horizontal axis is the liquid dielectric (e.g., water). The dotted line represents the liquid dielectric level corresponding to the bottom of the cantilevered source switch 104.

Referring back to the example dimensions of FIG. 1, the zero level of the water starts 4 μm below the cantilevered source switch 104. The capacitance is negligible prior to 3μ and, as level of the liquid dielectric 110 increase, the capacitance increases substantially linearly to 1.2 pF at an approximate liquid dielectric 110 level of 21 μm. It should be understood that the relationship between particular values of capacitance and liquid dielectric level depends on the particular dimensions of the switch. However, the capacitance starts to increase prior to the increasing water level reaching the gate-source gap. This may be a fringing capacitance component of the parallel plates (e.g., the cantilevered source switch 104 and the actuation gates 106). The maximum level of the liquid dielectric 110 may be limited by the drain 108 contacts. For instance, in this example embodiment the liquid dielectric covers at most 85% of the cantilever side walls. The 85% liquid dielectric 110 level may increase the $C_{gc}$ by 66 times compared to operation of the switch in air. The gate-source capacitance of the liquid dielectric MEMS switch 100 of this example embodiment may be empirically modeled as $$C_{gc}=0.065L_W-0.137\ [\text{pF}],\text{for } L_W\geq 4\ \mu\text{m}, \tag{4}$$

where $L_W$ is the liquid dielectric 110 level in micrometers.

The increase in $C_{gc}$ may be translated into an increase in the cantilevered source switch 104 actuation for a given voltage, or in other words a reduction in the required pull-in voltage.

Example Deflection Versus Actuation Voltage for Different Dielectric Levels

FIG. 5 illustrates a graph of source 104 deflection versus an applied voltage for various levels of liquid dielectric 110.

The graph is based on the example materials and dimensions discussed in FIG. 1, with water used as the liquid dielectric 110. The vertical axis is the maximum deflection of the source ranging from 0-0.5 um. The horizontal axis is the applied voltage ranging from 0-45 volts. Using the example materials and dimensions discussed in FIG. 1, the cantilevered source switch 104 reaches a maximum deflection of 0.5 μm at approximately 44V for air, 18V for a liquid dielectric level of 5%, 14V for a liquid dielectric level of 10%, 10V for a liquid dielectric level of 25%, and 5V for a liquid dielectric level of 85%.

A significant decrease in pull-in voltage may be achieved using a liquid dielectric 110 level as low as 5%. This result may be consistent with the gate-source capacitance discussed above in FIG. 4, where the fringing capacitance effect starts to appear when the level of the liquid dielectric 110 level does not reach the source 104. This may enable a reduction of the actuation voltage with little or no drag force added to the liquid dielectric MEMS switch 100.

Example Reduction in Pull-in Voltage Required for Full Actuation Versus Liquid Dielectric Level FIG. 6 illustrates a graph showing the pull-in voltage required for full actuation as a function of the liquid dielectric level. As with FIG. 5, the graph in FIG. 6 is based on the example materials and dimensions discussed in FIG. 1, with water used as the liquid dielectric 110. The vertical axis is the pull-in voltage ratio compared to air (e.g., $V_w/V_a$) ranging from 1/2 to 1/8. The horizontal axis is the liquid dielectric 110 level covering the side walls (e.g., housing 102) of the liquid dielectric MEMS switch 100, ranging from 5 to 85%. The pull-in voltage reduction increases substantially linearly from approximately 2.5 times at a liquid dielectric level of 5% to approximately 8.2 times at a liquid dielectric level of 85%, where the voltage is reduced from 44V to 5.3V.

Example Maximum Electric Field Between Gate and Source for Air and Liquid Dielectric FIG. 7A illustrates a graph of the maximum electric field as a function of the applied voltage on an actuation gate 106 and cantilevered source switch 104 in both air and in a liquid dielectric 110 at a level of 85%. As with FIGS. 5 and 6, the graph in FIG. 7A is based on the example materials and dimensions discussed in FIG. 1, with water used as the liquid dielectric 110. The vertical axis is the electric field and ranges from 160 to 270 $kVm^{-1}$. The horizontal axis is the voltage and ranges from 0 to 5.25V. The electric field between the gate and the channel in air starts approximately at 170 $kVm^{-1}$ at 0V and increases to a value of approximately 185 $kVm^{-1}$ at 5.25V. The electric field between the gate and the channel in the liquid dielectric 110 starts at an approximate value of 252 $kVm^{-1}$ at 0V and increases to an approximate value of 265 $kVm^{-1}$ at 5.25V. For both air and water, the electric field is much lower than the breakdown point of either air or water.

FIG. 7B illustrates a vertical cross section of a liquid dielectric MEMS switch 100 with an electric field displacement. The liquid dielectric MEMS switch 100 includes a cantilevered source switch 104, an active actuation gate 106*a*, an inactive actuation gate 106*b*, and is partially filled with liquid dielectric 110 (up to the horizontal line). The electric field displacement is confined within the liquid dielectric portion between the cantilevered source switch 104 and the active actuation gate 106*a* of the liquid dielectric MEMS switch 100. Additionally, the electric field displacement starts to increase below the cantilevered source switch, which may be a fringing capacitance component of the parallel plates (e.g., the cantilevered source switch 104 and the actuation gates 106), as discussed above in FIG. 4.

Example Process for Fabricating a Liquid Dielectric MEMS Switch

Referring now to FIG. 8, a process for fabricating a liquid dielectric MEMS switch is illustrated. As shown in block 802 of FIG. 8, a cantilevered source switch, such as source 104, is provided. The cantilevered source switch 104 may include an electrical input associated with an anchored end. The cantilevered source switch 104 may be any suitable conductive material, such as gold. The fabrication process continue to blocks 804 and 806 in an example embodiment in which the liquid dielectric MEMS switch is configured with a single gate and drain, or to blocks 808 and 810 in an instance in which the liquid dielectric MEMS switch 100 is configured with a dual gate and two drains.

As shown in block 804 of FIG. 8, a first actuation gate, such as gate 106, may be provided. The actuation gate 106 may be positioned so that it is parallel to the cantilevered source switch 104. The actuation gate 106 may be any suitable conductive material, such as gold. The actuation gate may also include an electrical actuation input.

As shown at block 806 of FIG. 8, a drain, such as drain 108 may be provided. The drain may be positioned so that it is parallel to the movable end of the cantilevered source switch 104. The drain 108 may any suitable conductive material, such as gold. The drain 108 may include an electrical output.

Alternatively, as shown at block 808 of FIG. 8, first and second actuation gates 106 may be provided. The first and second actuation gates 106 may be disposed on opposite sides of the cantilevered source switch 104 and may be positioned so that they are parallel to the cantilevered source switch 104. The first and second actuation gates 106 may each include a respective electrical actuation input.

In an example embodiment, the first and second actuation gates may be electrically connected to first and second input logic.

As shown at block 810 of FIG. 8, first and second drains 108 may be provided. The drains 108 may be disposed on opposite sides of the movable end of the cantilevered source switch 104 and may be positioned so that they are parallel with the movable end of the cantilevered source switch.

As shown at block 812 of FIG. 8, a liquid dielectric may be provided within a housing, such as housing 102, of the liquid dielectric MEMS switch 100. The liquid dielectric 110 may be gasoline, acetic acid, olive oil, ethanol, hydrazine, glycerin, water, or any other liquid dielectric with suitable permittivity. The liquid dielectric 110 may fill at least a portion of the volume between the cantilevered source switch 104 and the activation gates 106. In an example embodiment, the lowest liquid dielectric 110 volume level may be the bottom of the cantilevered source switch 104 (e.g., a fill level of approximately 5% in the example embodiment of FIG. 1). In some example embodiments, the maximum fill level may be lower than the drain 108 (e.g., less than or equal to a fill level of approximately 85% in the example embodiment of FIG. 1).

In an example embodiment, the liquid dielectric 110 may be provided to the liquid dielectric MEMS switch 110 through a gap below the cantilevered source switch 104. The gap acts as a microfluidic channel. Additionally, the gap between the cantilevered source switch 104 and the actuation gates 106 may have a capillary effect, which may draw the liquid dielectric 110 level up.

Additionally or alternatively, the liquid dielectric 110 may be provided to the liquid dielectric MEMS switch 100 by condensing a liquid dielectric vapor into the liquid dielectric MEMS switch 100. Condensation of a liquid dielectric vapor may allow the liquid dielectric to easily fill narrow parts of the liquid dielectric MEMS switch 100.

As shown at block 814 of FIG. 8, the first and second drain 108 may be electrically shorted. In an example embodiment, the first and second drains may be two sides of a common drain (e.g., one drain with two drain contact regions), as depicted in FIG. 3. Alternatively, the first and second drains 108 may be shorted by electrical connection of the electrical outputs.

In an example embodiment of the liquid dielectric MEMS switch 100 with electrically shorted drains 108 and first and second actuation gates electrically connected to first and second logic input, the liquid dielectric MEMS switch may satisfy a XOR logic or truth table. The cantilevered source switch 104 may be substantially centered when not actuated and might not be in contact with the drain 108. In an instance in which an actuation gate 106 is activated, the cantilevered source switch may make contact with the drain 108. In an instance in which both actuation gates 106 are activated simultaneously, the cantilevered source switch may remain in the substantially centered position.

The utilization of a liquid dielectric in a MEMS switch may reduce the pull-in voltage of the MEMS switch, therefore allowing smaller switches to be used with lower voltage supplies and lower power consumption. The liquid dielectric MEMS switches may be used in a variety of applications, such as those in which transistors are too fragile and traditional MEMS switches are too large. Some example settings for liquid dielectric MEMS switches are space and mining.

As described above, FIG. 8 illustrates a flowchart of process for fabricating a liquid dielectric MEMS switch according to example embodiments of the invention. In some embodiments, certain ones of the operations above may be modified or further amplified. Furthermore, in some embodiments, additional optional operations may be included, such as illustrated by the dashed outline of block 808, 810, and 814 in FIG. 8. Modifications, additions, or amplifications to the operations above may be performed in any order and in any combination.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A microelectromechanical system switch comprising:
- a cantilevered source switch;
- a first actuation gate disposed parallel to the cantilevered source switch;
- a first drain disposed parallel to a movable end of the cantilevered source switch; and
- a liquid dielectric material disposed within a housing of the microelectromechanical system switch.

2. The microelectromechanical system switch of claim 1, wherein the liquid dielectric material fills at least a portion of a volume between the cantilevered source switch and the first actuation gate.

3. The microelectromechanical system switch of claim 1, wherein the first drain is disposed outside the liquid dielectric material.

4. The microelectromechanical system switch claim 1, further comprising:
- a second actuation gate, wherein the first and second actuation gates are disposed on opposite sides of and parallel to the cantilevered source switch.

5. The microelectromechanical system switch of claim 4 further comprising:
- a second drain, wherein the first and second drains are disposed on opposite sides of and parallel to the movable end of the cantilevered source switch.

6. The microelectromechanical system switch of claim 5, wherein simultaneous activation of the first and second actuation gates causes the cantilevered source switch to maintain an unactuated position.

7. The microelectromechanical system switch of claim 5, wherein the first drain and second drain are electrically shorted.

8. The microelectromechanical system switch of claim 7, wherein the micorelectromechanical system switch satisfies an XOR logic, in an instance in which the first and second actuation gates are electrically connected to first and second input logic, respectively.

9. The microelectromechanical system switch of claim 1, wherein the liquid dielectric material is water.

10. The microelectromechanical system switch of claim 1, wherein the liquid dielectric material is one of water, gasoline, hydrazine, ethanol, olive oil, or acetic acid.

11. A method of fabrication of a microelectromechanical system switch comprising:
- providing a cantilevered source switch;
- providing a first actuation gate disposed parallel to the cantilevered source switch;
- providing a first drain parallel to a movable end of the cantilevered source switch; and
- providing a liquid dielectric material disposed within a housing of the microelectromechanical system switch.

12. The microelectromechanical system switch of claim 11, wherein the liquid dielectric material fills at least a portion of a volume between the cantilevered source switch and the first actuation gate.

13. The microelectromechanical system switch of claim 11, wherein the first drain is disposed outside the liquid dielectric material.

14. The microelectromechanical system switch of claim 11, further comprising:
- providing a second actuation gate, wherein the first and second actuation gates are disposed on opposite sides of and parallel to the cantilevered source switch.

15. The microelectromechanical system switch of claim 14 further comprising:

providing a second drain, wherein the first and second drains are disposed on opposite sides of and parallel to the movable end of the cantilevered source switch.

16. The microelectromechanical system switch of claim 15, wherein simultaneous activation of the first and second actuation gates causes the cantilevered source switch to maintain an unactuated position.

17. The microelectromechanical system switch of claim 15, wherein the first drain and second drain are electrically shorted.

18. The microelectromechanical system switch of claim 17, wherein the micorelectromechanical system switch satisfies an XOR logic, in an instance in which the first and second actuation gates are electrically connected to first and second input logic, respectively.

19. The microelectromechanical system switch of claim 11, wherein the liquid dielectric material is water.

20. The microelectromechanical system switch of claim 11, wherein the liquid dielectric material is one of water, gasoline, hydrazine, ethanol, olive oil, or acetic acid.

* * * * *